US005345248A

United States Patent [19]

Hwang et al.

[11] Patent Number: 5,345,248

[45] Date of Patent: Sep. 6, 1994

[54] STAGGERED HELICAL ARRAY ANTENNA

[75] Inventors: Yeong M. Hwang, Los Altos Hills; Vito J. Jakstys, Penn Valley; Chun C. Lee, Los Altos; Francis J. Kilburg, Mountain View, all of Calif.

[73] Assignee: Space Systems/Loral, Inc., Palo Alto, Calif.

[21] Appl. No.: 918,451

[22] Filed: Jul. 22, 1992

[51] Int. Cl.[5] ..... H01Q 1/36

[52] U.S. Cl. ..... 343/895; 343/879; 343/846

[58] Field of Search ..... 343/895, 893, 878, 887, 343/829, 845, 846, 879, 888, 893, 834, 835; H01Q 1/36

[56] References Cited

U.S. PATENT DOCUMENTS

| | | | |
|---|---|---|---|
| 2,630,530 | 3/1953 | Adcock et al. | 343/895 |
| 2,966,678 | 12/1960 | Harris | 343/809 |
| 3,383,695 | 5/1968 | Jarek | 343/895 |
| 3,569,977 | 3/1971 | Koller | 343/895 |
| 3,757,345 | 9/1973 | Carver | 343/786 |
| 3,988,737 | 10/1976 | Middlemark | 343/809 |
| 4,309,707 | 1/1982 | James et al. | 343/895 |
| 4,400,703 | 8/1983 | Shiokawa et al. | 343/895 |
| 4,427,984 | 1/1984 | Anderson | 343/764 |
| 4,460,899 | 7/1984 | Schmidt et al. | 343/841 |
| 4,494,117 | 1/1985 | Coleman | 343/895 |
| 4,766,444 | 8/1988 | Conroy et al. | 343/844 |

OTHER PUBLICATIONS

AP-S Symposium, Session 4, 1610, Tuesday, Oct. 12, Room 161, pp. 117-120.

Advertisement from Microwave Journal.

*Primary Examiner*—Donald Hajec

*Assistant Examiner*—Hoanganh Le

*Attorney, Agent, or Firm*—Perman & Green

[57] ABSTRACT

An antenna composed of an array of helical radiators has, in accordance with a methodology of the invention, a physical structure for reducing mutual coupling between closely spaced radiators so as to permit a reduction in spacing of the radiators. The radiators are mounted upon a mounting base, such as a ground plane element, with the helical radiators extending forward of the mounting base. Distances between the radiators and the mounting base are staggered in an amount approximately equal to one turn of a helix. The stagger distance corresponds approximately to one quarter of a free-space wavelength. The staggering significantly reduces the mutual coupling so as to permit closer spacing of the helical radiators such as, by way of example, in the formation of a feed directing radiant energy to a reflector of the antenna.

16 Claims, 5 Drawing Sheets

CONTOUR LEVELS dE

A = - 1 ---------
B = - 2 —·—·—
C = - 3 — — — —

STAGGERED HELICAL ARRAY ANTENNA

BACKGROUND OF THE INVENTION

This invention relates to antennas comprising an array of helical radiators and, more particularly, to a helical array antenna, or a feed in the case of a reflector antenna, wherein distances between the radiators and a mounting base, such as a ground plane or feed of the antenna, are staggered in an amount equal approximately to one turn of a helix.

A helical antenna is formed of an elongated electrical conductor, such as a wire or rod, which is wound in spiral fashion upon a central electrically-insulating support to form a helix wherein the support lies along an axis of the helix. Generally, the helix extends outward from a mounting base, such as a ground element or ground plane disposed behind the helix and perpendicularly to an axis of the helix. Upon application of an RF (radio frequency) signal, between a back end of the conductor and the ground element, the helix acts as a slow-wave structure and radiates an electromagnetic wave from the helix in the manner of an end-fire array. There results a relatively narrow beam of radiant energy which is directed along the helix axis in the forward direction.

To increase the power and directivity of the beam, a plurality of helical radiators may be arranged side-by-side along a common ground plane to produce a resultant beam which is a composite of the beams of the individual radiators. Alternatively, a beam can be given a desired shape by placing a reflector in front of a helical radiator. When several beams are to be provided, an antenna feed is constructed of several helical radiators which face a common reflector, and each radiator may be operated at slightly different radiation frequencies which distinguish the signals of the respective beams. In both of the foregoing examples, there is provided an array of helical radiators arranged side-by-side.

In such an array of radiators, each radiator retains its radiation characteristic if it is positioned at a sufficient distance from a neighboring radiator to insure no more than an insignificant amount of mutual coupling between the radiators. A minimal spacing, d, is given approximately by the product of the wavelength of the radiation multiplied by the square root of $(G/4\pi)$ where G is the gain of an individual helical radiator.

A problem arises in a situation wherein it is desired to space two helical radiators more closely together than the minimum spacing, d. There results a mutual coupling which degrades the end-fire radiation pattern of each helical radiator. This is disadvantageous in a situation wherein it is desired to mount the radiators as close as possible to the focal point of a reflector so as to generate, for example, equally formed beams of radiation at each of separate frequency bands to be transmitted (or received) by the antenna. Also, the feed for a reflector antenna may have closely positioned radiators to generate the single beam of radiation having far more power than is available from a single radiator. In either of the foregoing examples, the minimum spacing between radiators has been limited, as noted above, to avoid excessive mutual coupling between the radiators. As a result, there is less control over the beam pattern than would be desirable.

SUMMARY OF THE INVENTION

The aforementioned problem is overcome and other advantages are provided by a helical radiator array antenna embodying a physical structure in accordance with a methodology of the invention which provides for a reduction of mutual coupling between adjacent radiators. The reduction of mutual coupling is accomplished by introduction of staggered distances between the radiators and a mounting base. The mounting base may serve the dual functions of supporting the radiators as well as serving as a ground plane which interacts with the radiators to form one or more beams of radiation. In accordance with the usual construction of a helical radiator, the electrically conductive helix serves as a slow-wave structure which supports propagation of an electromagnetic wave. The electromagnetic wave radiates from each of the radiators in the manner of an end-fire array in a forward direction of the radiator, away from the mounting plate. The spacing between turns of the helix is approximately one-quarter of a free-space wavelength, and the amount of the staggered distance is approximately equal to one turn of the helix. The antenna may include a reflector placed in front of the radiators for shaping a beam of radiation produced by the radiators. The radiators may be individually excited with RF signals to provide a plurality of beams of slightly differing frequencies. The invention provides the advantage that, by reduction of the mutual coupling, the radiators can be placed significantly closer than has been possible heretofore, thereby allowing all of the radiators to be placed more nearly at a focal point of the reflector for more accurate beam definition.

BRIEF DESCRIPTION OF THE DRAWING

The aforementioned aspects and other features of the invention are explained in the following description, taken in connection with the accompanying drawing wherein.

DETAILED DESCRIPTION

Figure 1:
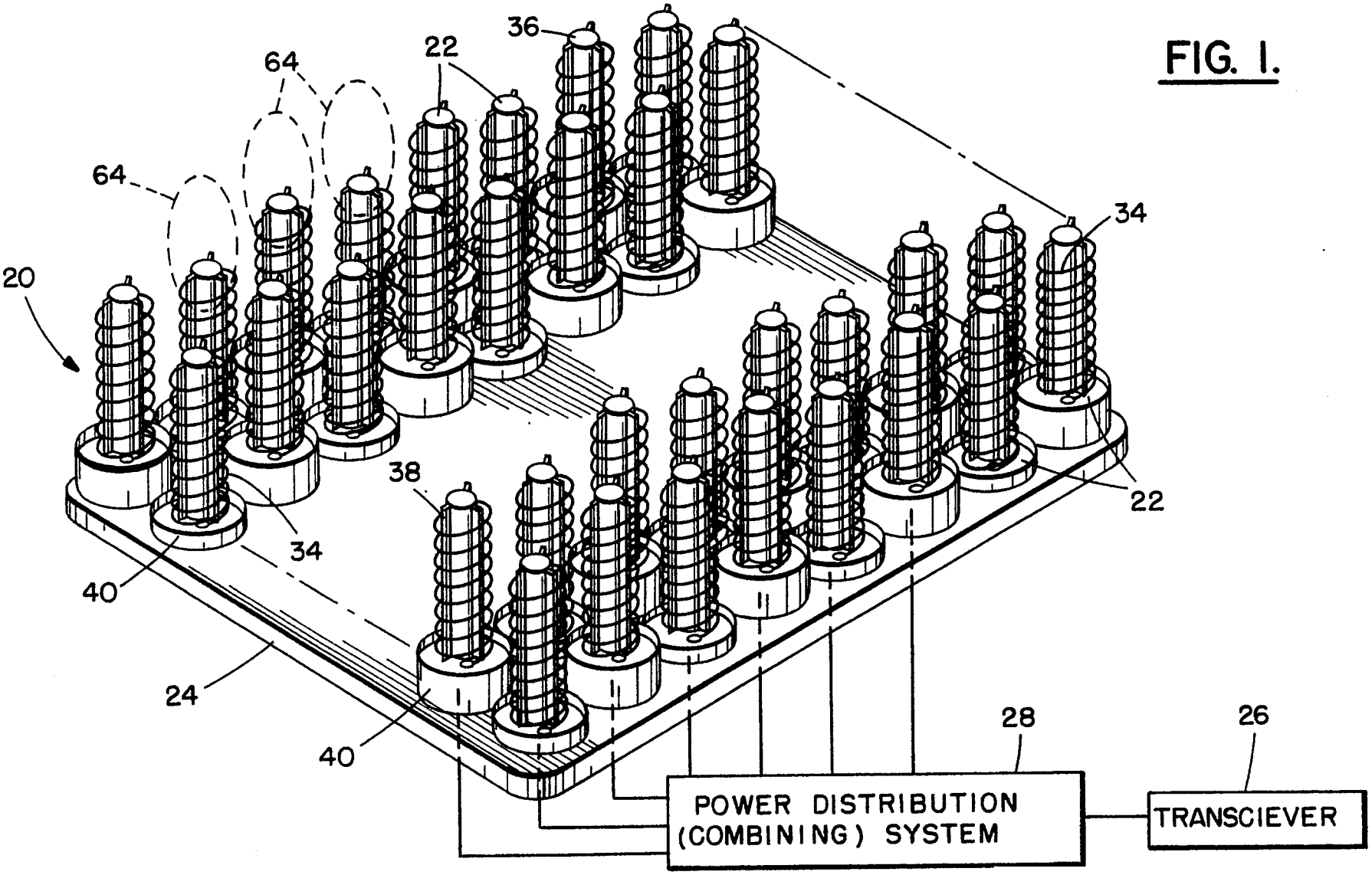
FIG. 1 is a perspective view, partially stylized of an antenna having helical radiators disposed in an array of rows and columns.

FIG. 1 shows an antenna 20 comprising a plurality of helical radiators 22 disposed in an array of rows and columns, and extending forward of a mounting base 24 which supports the radiators 22. The antenna 20 may be employed for transmitting one or more beams of radiation, in which case a transmitter would be coupled to the antenna for energizing the radiators with electromagnetic signals to be radiated from the antenna 20. Alternatively, the antenna 20 may be employed for receiving electromagnetic signals, in which case a receiver would be coupled to the antenna 20. The functions of the transmitter and the receiver are shown by a transceiver 26 connected to individual ones of the radiators 22 by a power distribution system 28. During transmission of electromagnetic signals, the distribution system 28 serves to divide the power outputted by the transceiver 26 among the radiators 22 and, during reception of electromagnetic power, the distribution system 28 operates in reciprocal fashion to combine the signals received by the individual radiators. If desired, the distribution system 28 may include phase shifters (not shown) for adjusting phases of signals of the various radiators 22 to provide a desired configuration to a beam radiated from (or received by) the antenna 20. In the ensuing description of the invention, reference is made to the transmission of one or more beams of radiation in order to simplify the description, it being understood that the principles of the invention apply also to the reception of one or more beams of radiation.

Figure 2:
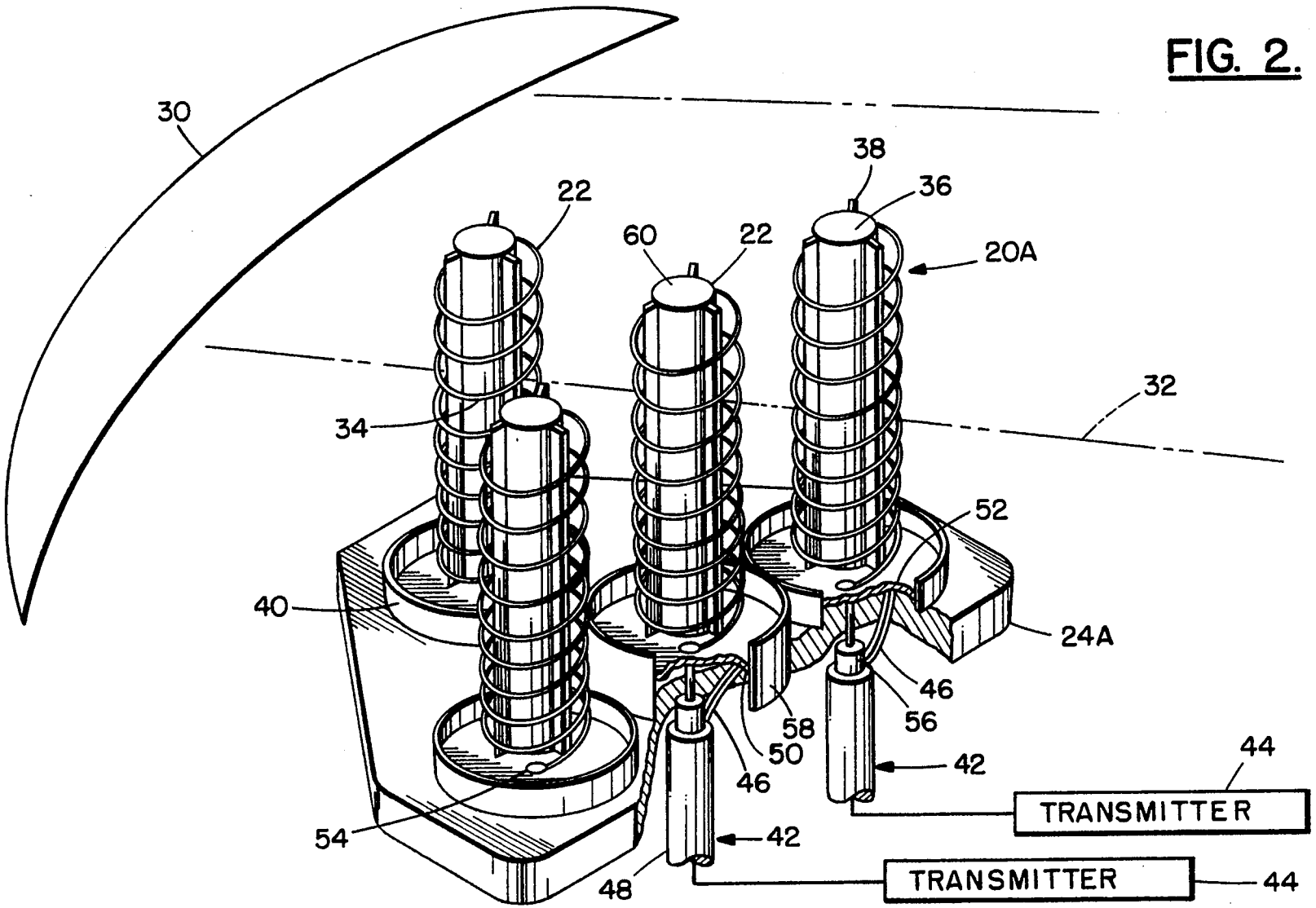
FIG. 2 is a perspective view of an antenna, partially stylized, and partially cutaway to show connections of coaxial feed lines to individual radiators.
Figure 3:
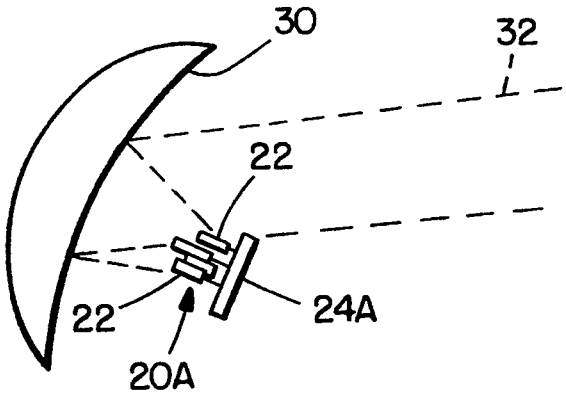
FIG. 3 is a diagrammatic view of the antenna of FIG. 2 showing location of a feed structure at a focal point of a reflector of the antenna.
Figure 4:
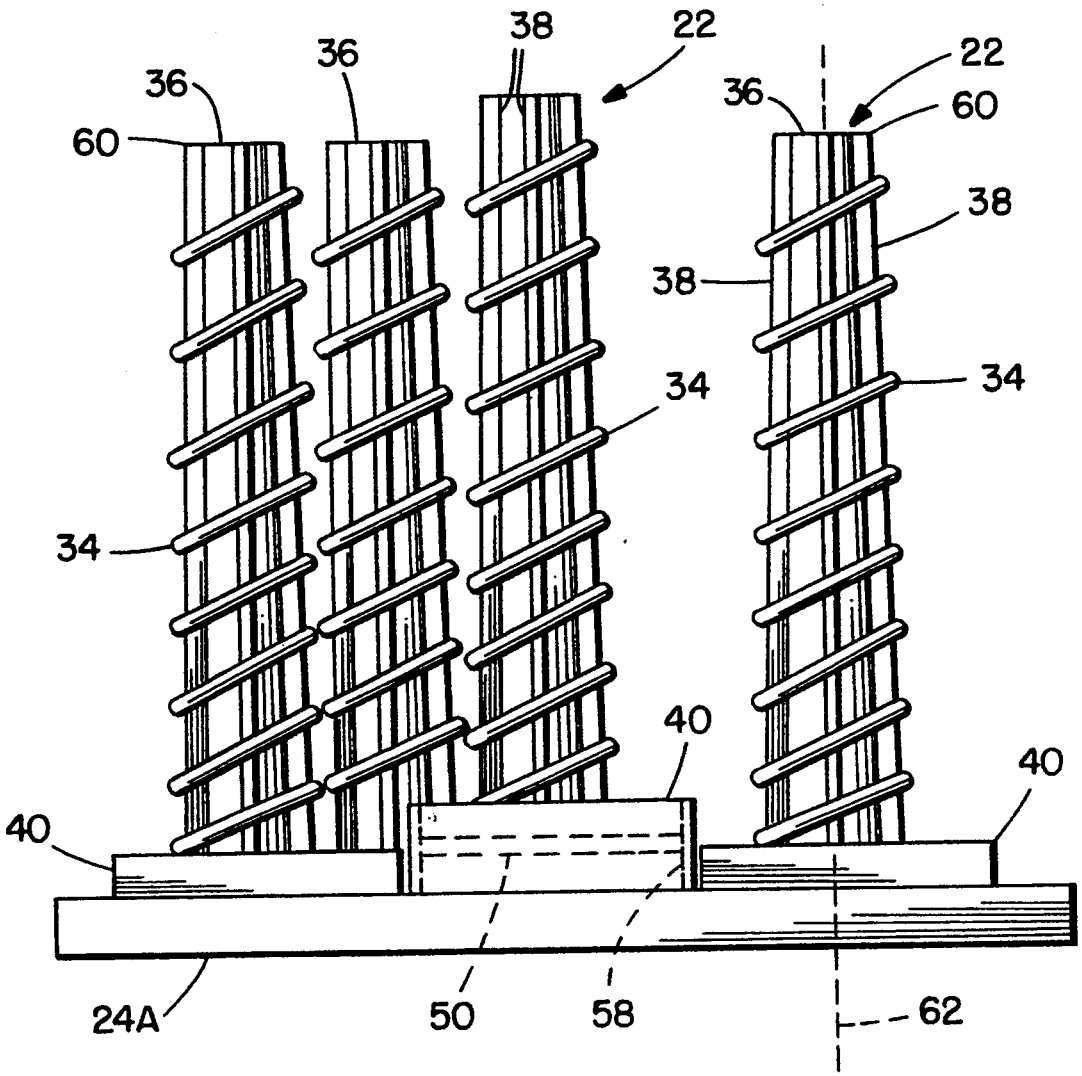
FIG. 4 is a side elevation view of a feed portion of the antenna of FIG. 2, FIG. 4 showing a staggering of positions of radiators relative to a mounting base in accordance with the invention.

FIGS. 2–4 shows an antenna 20A comprising four helical radiators 22 disposed on a mounting base 24A, and a reflector 30 for directing radiation from the radiators 22 to form one or more beams 32 of electromagnetic radiation. The array of the radiators 32 is centered at the focus of the reflector 30.

With reference to FIGS. 1–4, each of the radiators 22 comprises a radiating element in the form of a helix 34 supported on an elongated central core 36 having radially extending fins 38 which contact turns of the helix 34. The material of the core 36 may be a rigid plastic of low dielectric constant, such as Kevlar. A back end of each radiator 22, facing the mounting base 24, 24A is provided with an encircling cup 40 of electrically-conductive material, such as aluminum, which acts electrically as a cavity for each radiator 22. As shown in FIG. 2, each radiator 22 connects via a coaxial transmission line 42 to a source of electromagnetic signal. While, in FIG. 1, the source of electromagnetic signal is shown as the transceiver 26, in the embodiment of the invention shown in FIG. 2, a separate source of signal in the form of a transmitter 44 is provided for each of the radiators 22, the transmitters 44 being coupled via the coaxial transmission lines 42 to respective ones of the radiators 22. Connection of the transmission lines 42 to the respective radiators 22 is accomplished, in well-known fashion for each of the radiators 22, by connecting a tab 46 of an outer electrically conductive shield 48 to a floor 50 of a cup 40, and by passing a central conductor 52 of the transmission line 42 via an aperture 54 in the floor 50 to connect with the helix 34. The central conductor 52 and the shield 48 are separated by an electrically insulating layer 56 of the transmission line 46. The insulating layer 56 may extend through the aperture 54 to insulate the central conductor 52 from the floor 50, such extension of the layer 56 being omitted in FIG. 2 to simplify the drawing.

In the construction of the antennas 20 and 20A, all of the radiators 22 are constructed, preferably, with the same length of helix. The base 24 (FIG. 1) serves as a ground plane for the antenna 20, and the base 24A (FIGS. 2–4) serves as a ground plane for a feed structure of the antenna 20A. Each of the radiators 22 radiates a circularly polarized electromagnetic wave. Each of the radiators 22 has a tapered form wherein the back end of the radiator 22, at the floor 50 of a cup 40, has a diameter of approximately two inches while the opposite, or front, end has a diameter of approximately one-half inch in a preferred embodiment of the invention operative at S band frequency. Each helix 34 is constructed in accordance with customary practice with a standard pitch between turns of the helix, and with a total of approximately 9.5 turns of the helical conductor. Each of the radiators 22 radiates in the manner of an end-fire array.

In accordance with a feature of the invention, some of the cups 40 are provided with pedestals 58 which displace the cups 40 and their radiator 22 away from the mounting base 24, 24A so as to stagger the positions of some of the radiators 22 with respect to the positions of other ones of the radiators 22 relative to the mounting base 24, 24A. Thus, the helix 34 of a radiator 22 standing on a pedestal 58 is displaced relative to turns of helixes 34 of adjacent radiators 22 which stand directly on the mounting base 24, 24A. This displacing of the helixes 34 results in a significant reduction of mutual coupling between adjacent radiators 22. As is well known, the structure of a helix 34 functions as a slow-wave structure for electromagnetic waves propagating from the back end of a radiator 22, adjacent the base 24, 24A, in a forward direction towards the front end 60 of a radiator 22. The resulting slow wave traveling along a helix 34 continuously couples with the environment external to the radiator 22, in the manner of an end-fire array antenna structure, to produce a beam of radiation directed forwardly along the central axis 62 of the radiator 22. In FIG. 1, the beams generated by the individual ones of the radiators 22, such as the beams shown at 64 (FIG. 1), combine to form a single beam of high directivity and high power. In FIG. 2, wherein the radiators 22 may be energized at slightly different frequencies of radiation, a plurality of four separate beams are generated by the four radiators 22. The reflector 30 serves to gather the radiation emitted by each of the radiators 22 to form a set of closely spaced beams 32 which are directed towards a suitable receiving area.

Figure 5:
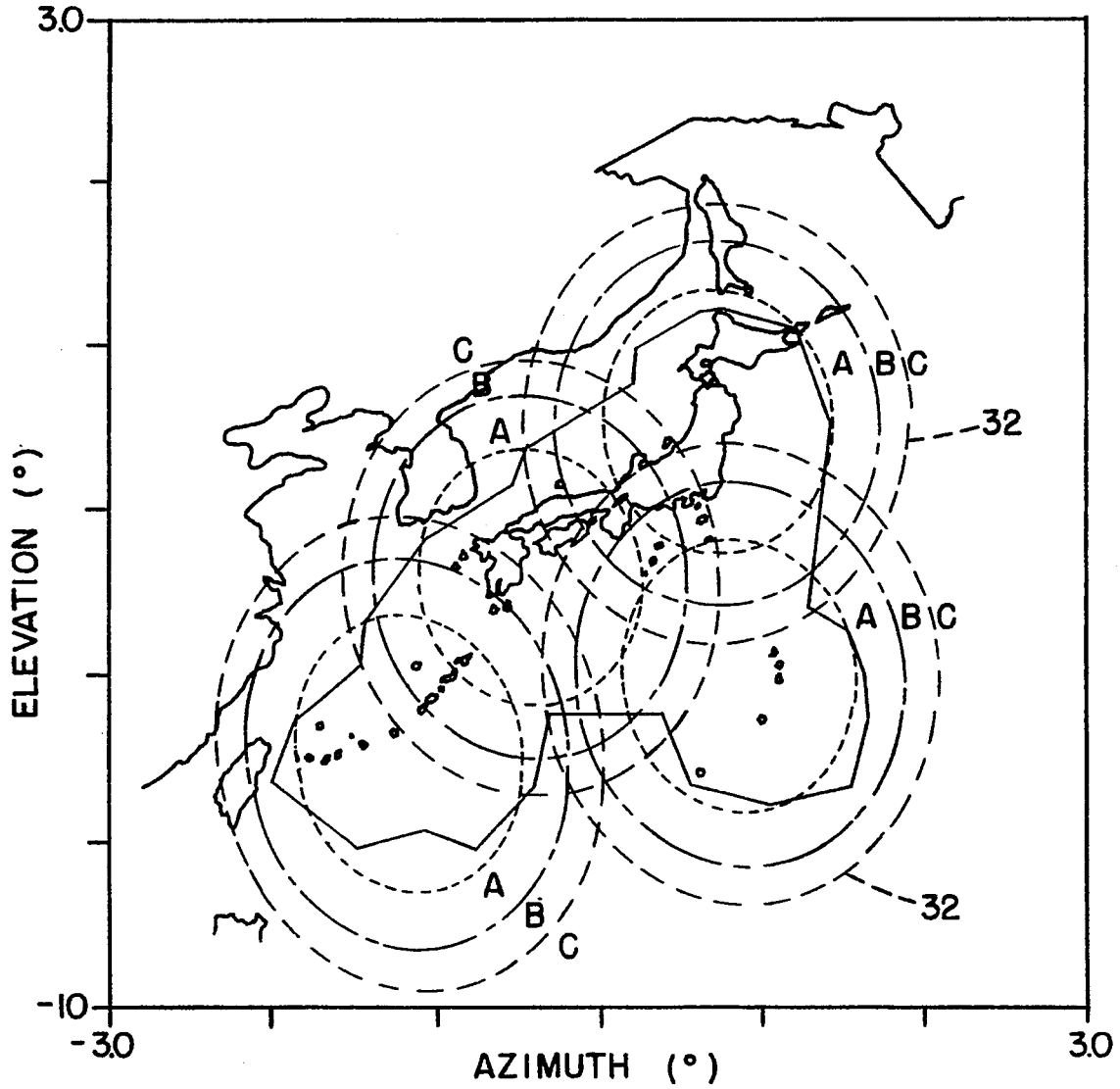
FIG. 5 shows a map of earth's terrain illuminated by four separate beams produced by the antennas of FIGS. 2–3.

With reference to FIG. 5, and by way of example in the use of the antenna 20A of FIG. 2, the antenna 20A is carried by a satellite (not shown) encircling the earth, and the beams 32 are directed to a portion of the earth's surface depicted in the map of FIG. 5. Due to the close spacing of each of the radiators 22 relative to the focus of the reflector 30, the resulting beams are substantially parallel to each other with only a slight amount of divergence which allows for substantial overlap among the areas of the earth's surface illuminated by the respective beams. By way of example, three contour levels of signal strength for each of the beams are shown in decibels (dB), as indicated in FIG. 5 wherein, significant overlap is found at fringe areas of the beams of lower signal intensity, with lesser overlap being found at the higher levels of signal intensity at the central portions of the beams 32. With respect to the construction of the antenna 20A in a satellite, the four radiators 22 with the mounting base 24A supporting the radiators 22 constitute a feed which is supported by means (not shown) at a distance from the reflector 30 which is supported by separate means (not shown). Also, it is advantageous to construct the feed in a manner which reduces overall weight of the feed. Thus, while a helix 34 may be constructed of a rod of electrically conductive material, such as copper or aluminum, in the case of a satellite, the rod would be replaced with metallic tubing, a tubing having an outer diameter of two millimeters having been employed in the preferred embodiment of the invention operating at S band. Also, while the base 24A may be constructed of a solid metal plate, such as a copper or aluminum plate, in the case of a satellite, it is preferable to construct the base 24A of a metal honeycomb. Similar construction techniques may be employed for the radiators 22 and the mounting base 24 of FIG. 1.

In accordance with the invention, the reduction of the mutual coupling between adjacent radiators 22, resulting from the staggering of the radiators 22, permits the radiators 22 to be positioned more closely together than has been possible heretofore. This is particularly important with the antenna 20A of FIG. 2 wherein each radiator 22 operates in a slightly different frequency of electromagnetic signal to produce the four separate beams 32 depicted in FIG. 5. By positioning the radiators 22 more closely together, the overall size of the feed structure is decreased, and each of the radiators 22 is located more closely to the focus of the reflector 30. As a result, the illumination of the four areas shown in the map of FIG. 5 is accomplished with less chance of gaps between the illuminated regions, and by providing that, even at the highest levels of signal intensity, the corresponding contours of the beams are either contiguous or overlapping so as to ensure reception at high signal strength throughout the region to be illuminated by the four beams.

The amount of stagger in the positions of adjacent radiators 22 relative to the mounting base 24, 24A is approximately equal to the pitch, namely, one turn of the helix which, in the preferred embodiment of the invention has a value of approximately 1.1 inches. In the preferred embodiment of the invention operative at 2.518 gigahertz (GHz), by way of example, the overall length of a helix 34, as measured along is central axis 62, is 10.4 inches, this being equal to approximately 2.2 free-space wavelengths of the radiation, with the wavelength being equal to 4.69 inches.

Figure 6:
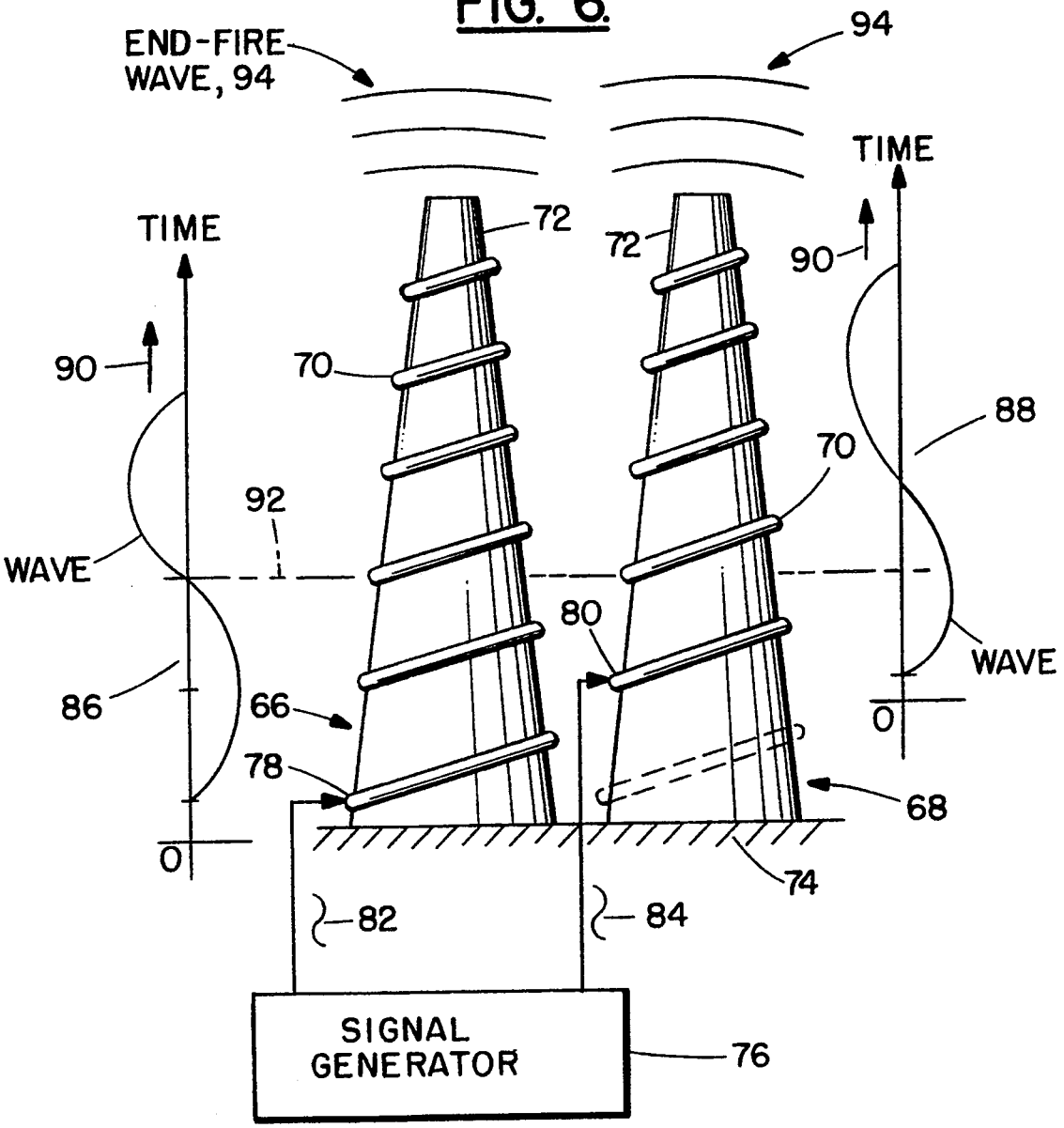
FIG. 6 is a diagrammatic view of two helical radiators disposed side-by-side and having different locations of points for connection of feed lines to helical elements of the radiators.

FIG. 6 shows two slow-wave structures 66 and 68 each of which comprises an electrically-conductive element wound in the form of a helix 70, and an electrically-insulating core 72 which supports the helix 70. Each of the cores 72 has a tapered conical shape, as does each of the helixes 70, with the broadened base of each core 72 resting upon a ground plane 74. The signal generator 76 supplies signals to each of the slow-wave structures 66 and 68.

The diagrammatic representation of FIG. 6 is useful in explaining principles of the invention. Energization of the slow-wave structure 66 is accomplished by connecting an output signal of the generator 76 to a feed point 78 at a location on the helix 70 close to the ground plane 74. Energization of the slow-wave structure 68 is accomplished by connecting an output signal of the generator 76 to a feed point 80 on the helix 70 positioned at greater distance from the ground plane 74 than is the feed point 78 of the slow-wave structure 66. The two feed points 78 and 80 differ in their spacing from the ground plane 74 by one period of the periodic form of either of the structures 66 and 68. In FIG. 6, both of the slow-wave structures 66 and 68 are assumed to have the same periodicity. By impressing sinusoidal electromagnetic signals 82 and 84 upon each of the slow-wave structures 66 and 68, there is produced an electromagnetic wave which travels along the helix 70 in each of the structures 66 and 68 wherein, as viewed in a longitudinal plane intersecting the structures 66 and 68, there are provided electromagnetic waves which couple into the external environment and are launched from the slow-wave structure 66 and 68 in the manner of an end-fire array.

The wave of the structure 66 is portrayed in a graph 86, and the wave for the structure 68 is portrayed in a graph 88. The two graphs 86 and 88 are displaced in correspondence with the displacement between the feed points 78 and 80. The resulting waves propagate forwardly in the direction of the arrows 90, and are out of step with each other by an amount equal to the displacement between the feed points 78 and 80. In the structure 68, the bottom turn of the helix 70 is shown in phantom because it does not participate in the generation of the forward wave but, rather, generates a wave in the backward direction which, if not absorbed, would be reflected and propagate in the forward direction. For purposes of understanding operation of the invention, it is presumed that any such backward wave has been absorbed. Thus, upon viewing the waves of the graphs 86 and 88 at a common distance from the ground plane 74, such as at the distance represented by the line 92, it is observed that the waves of the graphs 86 and 88 are out of phase with each other.

In the preferred embodiment of the invention the phase difference between the waves of the graphs 86 and 88 is approximately one-quarter wavelength as measured along the aforementioned longitudinal plane. This inhibits mutual coupling between the two waves so as to allow each of the end-fire waves 94 propagated from the slow-wave structure 66 and 68 to maintain the relatively high gain of an end-fire radiation pattern without interference from the proximity of the neighboring slow-wave structure. It is noted that while the slow-wave structures 66 and 68 are portrayed as helical structures, the foregoing analyses applies to other forms of slow-wave structures. In the preferred embodiment of the invention, the offsetting of the feed point 78 and 80 is accomplished by physically displacing a radiator 22 relative to the adjacent radiator 22 as has been disclosed with reference to FIGS. 1–4.

Figure 7:
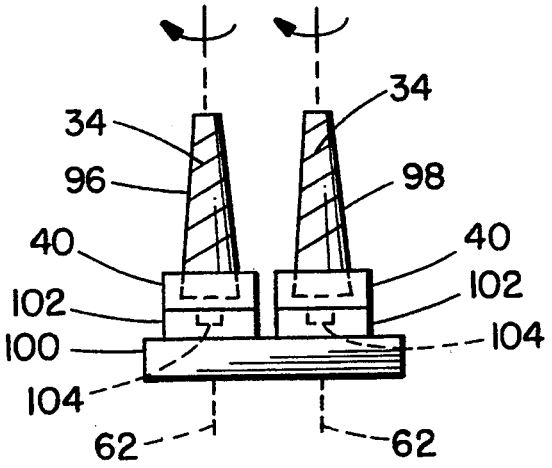
FIG. 7 shows diagrammatically a simplified antenna feed including rotational supports allowing rotation of a radiator about its longitudinal axis relative to a supporting mounting base.

FIG. 7 shows apparatus for providing further adjustment of the phasing of the waves in the graphs 86 and 88 of FIG. 6. In FIG. 7, two helical radiators 96 and 98 are provided with helixes 34 and cups 40, and are mounted to an electrically-conducting base 100 by means of metallic blocks 102 having bearings 104 therein. Electrical continuity from the ground plane is established by electrical connections between the cups 40 and the corresponding blocks 102 to the base 100. Each of the bearings 104 permits rotation of a radiator 96, 98 about the corresponding axis 62 relative to the corresponding block 102. With the arrangements of FIG. 7, the feed points 78 and 80 (FIG. 6) can be rotated relative to each other by several degrees to fine tune the phasing between the waves of the graphs 86 and 88 to maximize a decoupling of the two waves with minimization of mutual coupling between the radiators 96 and 98.

It is to be understood that the above described embodiments of the invention are illustrative only, and that modifications thereof may occur to those skilled in the art. Accordingly, this invention is not to limited to the embodiments disclosed herein, but is to be limited only as defined by the appended claims.

What is claimed is:

1. An array antenna comprising:

a mounting base;

a plurality of helical radiators disposed in an array and extending forward of said mounting base, each of said radiators having a feed connection point located at a distance from said mounting base, each of said radiators comprising a radiating element disposed about an axis extending forward of said base, said radiators being arranged in said array with their respective axes spaced apart from each other; and means connected between said mounting base and individual ones of said radiators for staggering the distances of said feed connection points of said radiators from said mounting base, said staggering reducing mutual coupling among said radiators;

wherein said feed connection points of alternate ones of said radiators in said array are staggered in location relative to said feed connection points of other ones of said radiators in said array; and the distance of staggering is equal approximately to a spacing between turns of a helix in any one of said radiators.

2. An antenna according to claim 1 wherein said mounting base is an electrically conductive ground plane.

3. An antenna according to claim 1 wherein each of said radiators has the same helical pitch.

4. An antenna according to claim 1 wherein, in each of said radiators, said feed connection point is located at an end of the radiator facing said mounting base, and said staggering means staggers distances of said radiators from said mounting base.

5. An array antenna comprising:

a mounting base;

a plurality of helical radiators disposed in an array and extending forward of said mounting base, each of said radiators having a feed connection point located at a distance from said mounting base, each of said radiators comprising a radiating element disposed about an axis extending forward of said base, said radiators being arranged in said array with their respective axes spaced apart from each other; and means connected between said mounting base and individual ones of said radiators for staggering the distances of said feed connection points of said radiators from said mounting base, said staggering reducing mutual coupling among said radiators;

wherein said feed connection points of alternate ones of said radiators in said array are staggered in location relative to said feed connection points of other ones of said radiators in said array;

each of said radiators has the same helical pitch;

a spacing between turns of helix in any one of said radiators is equal approximately to one-quarter of a free-space wavelength of radiation to be radiated from said antenna; and said distance of staggering is equal approximately to said spacing between turns.

6. An antenna according to claim 5 further comprising a reflector disposed in front of said radiators, said mounting base being disposed behind said radiators, said reflector being operative with radiation incident thereon from any one of said radiators to form a beam of radiation, and said antenna including means for coupling individual sources of electromagnetic power to individual ones of said radiators.

7. An antenna according to claim 6 wherein, in each of said radiators, said feed connection point is located at an end of the radiator facing said mounting base, and said staggering means staggers distances of said radiators from said mounting base.

8. A method of reducing mutual coupling between helical radiators of an array antenna comprising steps of:

mounting said radiators parallel to each other on a mounting base of said antenna, each of said radiators having a feed connection point located at a distance from said mounting base, each of said radiators comprising a radiating element disposed about an axis extending forward of said base, said mounting including an arranging of said radiators in an array with their respective axes spaced apart from each other; and staggering the distances between said feed connection points and said base to provide for greater and lesser amounts of the distances;

wherein said staggering of distances provides a distance of staggering which is equal approximately to a spacing between turns of a helix in any one of said radiators.

9. A method according to claim 8 wherein, in each of said radiators, said feed connection point is located at an end of the radiator facing said mounting base, and said staggering is accomplished by staggering distances between said radiators and said mounting base.

10. A method according to claim 9 wherein said distances are measured between said base, and a central portion of each of said radiators.

11. A method of reducing mutual coupling between helical radiators of an array antenna comprising steps of:

mounting said radiators parallel to each other on a mounting base of said antenna, each of said radiators having a feed connection point located at a distance from said mounting base, each of said radiators comprising a radiating element disposed about an axis extending forward of said base, said mounting including an arranging of said radiators in an array with their respective axes spaced apart from each other; and staggering the distances between said feed connection points and said base to provide for greater and lesser amounts of the distances;

wherein, in each of said radiators, said feed connection point is located at an end of the radiator facing said mounting base, and said staggering is accomplished by staggering distances between said radiators and said mounting base; and said distances are equal approximately to a spacing between turns of a helix of one of said radiators, and the helices of the respective radiators are equal in length.

12. A method of reducing mutual coupling between helical radiators of an array antenna comprising steps of:

mounting said radiators parallel to each other on a mounting base of said antenna, each of said radiators having a feed connection point located at a distance from said mounting base, each of said radiators comprising a radiating element disposed about an axis extending forward of said base, said mounting including an arranging of said radiators in an array with their respective axes spaced apart from each other; and staggering the distances between said feed connection points and said base to provide for greater and lesser amounts of the distances;

wherein said distances are equal approximately to a spacing between turns of a helix of one of said radiators.

13. An array antenna comprising:

a mounting base;

a plurality of radiators having equal periodic slow-wave structures disposed in an array and extending forward of said mounting base for radiating radiation as end-fire radiators, each of said radiators having a feed connection point disposed at a distance from said mounting base, each of said radiators comprising a radiating element disposed about an axis extending forward of said base, said radiators being arranged in said array with their respective axes spaced apart from each other;

wherein the distances of said feed connection points of said radiators from said mounting base are staggered, staggering of said distances reducing mutual coupling among said radiators, the distances of a first plurality of said feed connection points from said mounting base being different from the distances of a second plurality of said feed connection points from said mounting base; and the distance of staggering is equal approximately to the periodicity of the slow-wave structure in any one of said radiators.

14. An array antenna comprising:

a mounting base;

a plurality of radiators having equal periodic slow-wave structures disposed in an array and extending from said mounting base for radiating radiation as end-fire radiators, each of said radiators having a feed connection point spaced from said mounting base, each of said radiators comprising a radiating element disposed about an axis extending forward of said base, said radiators being arranged in said array with their respective axes spaced apart from each other;

wherein said feed connection points of individual ones of said radiators in said array differ in spacing from said mounting base; and the difference of spacing is equal approximately to the periodicity of the slow-wave structure in any one of said radiators.

15. An array antenna comprising:

a mounting base;

a plurality of helical radiators disposed in an array and extending forward of said mounting base, each of said radiators having a feed connection point, each of said radiators comprising a radiating element disposed about an axis extending forward of said base, said radiators being arranged in said array with their respective axes spaced apart from each other;

means connected between said mounting base and individual ones of said radiators for staggering distances of said feed connection points of said radiators from said mounting base, said staggering reducing mutual coupling among said radiators;

wherein said feed connection points of individual ones of said radiators in said array differ in distance from said mounting base; and the distance of staggering is equal approximately to a spacing between turns of a helix in any one of said radiators.

16. A method of reducing mutual coupling among radiators in an array of radiators of an antenna, the radiators having equal periodic slow-wave structures; the method comprising steps of mounting said radiators on a base of said antenna with the radiators extending from said base, each of said radiators comprising a radiating element disposed about an axis extending forward of said base, said mounting including an arranging of said radiators in the array with their respective axes spaced apart from each other;

providing each of said radiators with a feed connection point spaced from said base;

adjusting each of said radiators to stagger spacings between said feed connection points and said base for greater and lesser amounts of the spacings between various ones of said feed connection points and said base; and wherein said staggering of spacings provides a stagger spacing which is equal approximately to the periodicity of the slow-wave structure in any one of said radiators.

* * * * *